United States Patent [19]

Chiesa

[11] Patent Number: 4,838,471

[45] Date of Patent: Jun. 13, 1989

[54] NAILING DEVICE

[76] Inventor: David Chiesa, 528 Powers Ave., Johnsonburg, Pa. 15845

[21] Appl. No.: 131,451

[22] Filed: Dec. 11, 1987

[51] Int. Cl.[4] ..... B25C 1/02

[52] U.S. Cl. ..... 227/142; 227/147

[58] Field of Search ..... 227/147, 142; 173/91, 173/115

[56] References Cited

U.S. PATENT DOCUMENTS

| | | | |
|---|---|---|---|
| 1,016,383 | 2/1912 | Wellman . | |
| 2,031,024 | 1/1935 | Ahlquist . | |
| 2,098,495 | 11/1937 | Greenberg | 173/115 |
| 2,430,532 | 11/1947 | Rayburn | 227/142 |
| 2,587,944 | 3/1952 | Williams | 173/115 |
| 2,783,799 | 3/1957 | Hart . | |
| 2,839,754 | 6/1958 | Pfaff | 227/147 |
| 2,979,092 | 4/1961 | Bradford . | |
| 3,013,272 | 12/1961 | Barratt | 227/142 X |
| 3,391,842 | 7/1968 | Mathes | 227/147 |
| 3,788,537 | 1/1974 | Fox | 227/142 |
| 4,316,513 | 2/1982 | Harris | 173/91 |
| 4,367,836 | 1/1983 | Hodson | 227/142 |
| 4,390,050 | 6/1983 | Whitney . | |
| 4,403,725 | 9/1983 | Lawrence | 81/44 X |

*Primary Examiner*—Frank T. Yost
*Assistant Examiner*—James L. Wolfe
*Attorney, Agent, or Firm*—Jerry T. Kearns

[57] ABSTRACT

A hand held nailing device for use in starting, driving, and setting nails is composed of a hollow cylindrical barrel having a stepped diameter longitudinal bore. An abutment shoulder is formed by the intersection of first and second diameter portions of the longitudinal bore. A stepped diameter cylindrical ram is slidably received within the barrel. An annular stop face is formed by the intersection of a first smaller diameter portion and a second layer diameter portion of the cylindrical ram. A spring ball detent is utilized to retain a nail in the barrel by engaging the nail head. By striking the end of the ram, the nail will be driven into the desired location on a work surface until the stop face on the ram contacts the abutment shoulder within the barrel. By appropriately dimensioning the barrel and the ram, the device may be adapted for use with a variety of different sized nails. An adjustable length ram may be provided for varying the depth to which a nail will be driven and a two piece construction of the nailing device may be employed whereby adaptor tips may be changed for use with different sizes of nails.

3 Claims, 3 Drawing Sheets

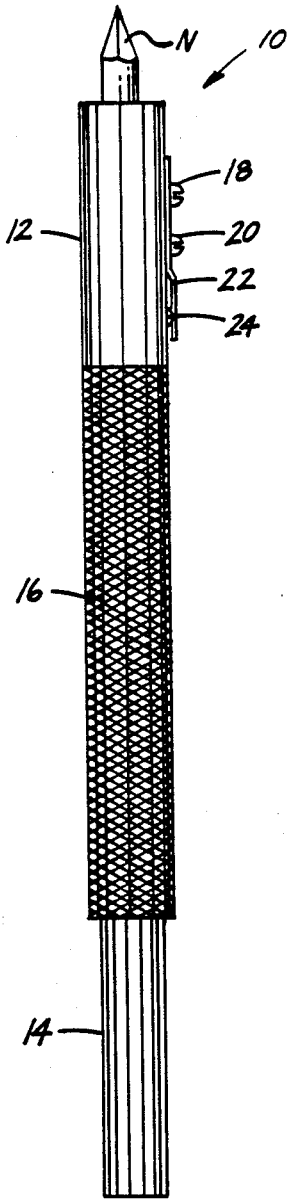
FIG 1
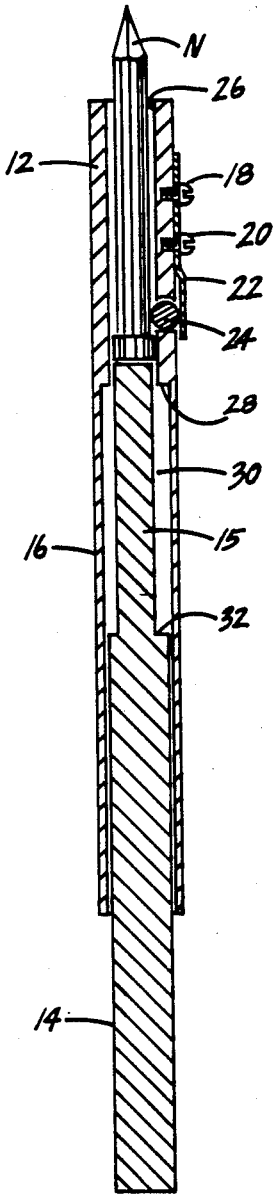
FIG 2
FIG 3
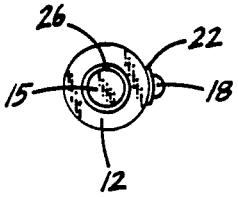
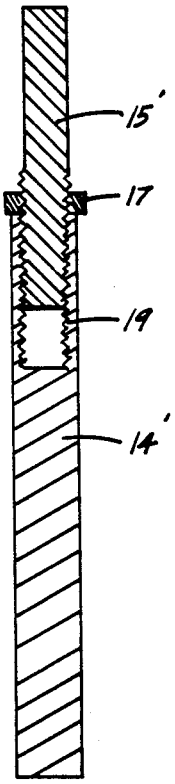
FIG 4

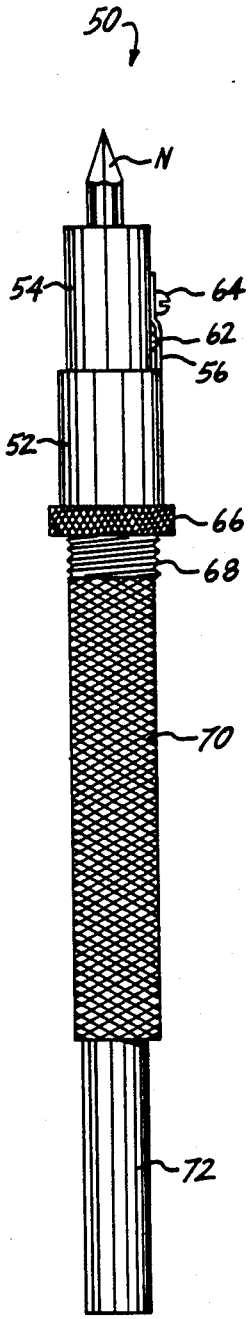
FIG 5
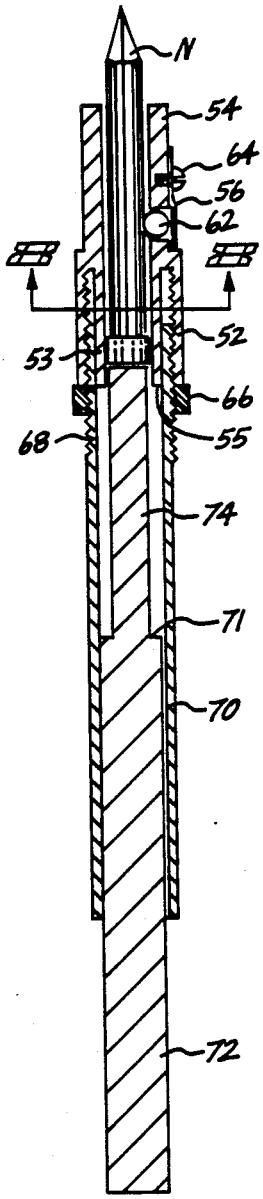
FIG 6
FIG 7
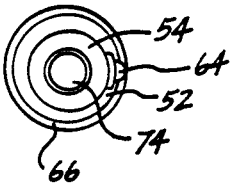
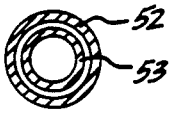
FIG 8

NAILING DEVICE

BACKGROUND OF THE INVENTION

1. Field of the Invention

The present invention relates to nailing devices, and more particularly pertains to a new and improved nailing device for use in starting, driving, and setting nails. In wood working operations, it is necessary to precisely position and drive nails. Especially when using small finishing nails, it is difficult to correctly position and set the nails by hand. Conventionally, a nail set which resembles a small headed punch is utilized to drive the nail head slightly below the surface of a work piece being nailed. This conventional practice requires a time consuming manual manipulation of the nail to start and drive the nail and a subsequent manipulation of the nail set punch. In order to provide a more efficient nailing device, the present invention utilizes a single tool which is utilized in starting, driving and setting the nail, without the need for any manual manipulation of the nail. This precludes the possibility of striking one's fingers while driving the nail.

2. Description of the Prior Art

Various types of nailing devices are known in the prior art. A typical example of such a nailing device is to be found in U.S. Pat. No. 1,016,383, which issued to W. Wellman on Feb. 6, 1912. This patent discloses a combination tool for manipulating tongue and groove flooring which has a cylindrical bore and a cooperating cylindrical ram for driving and setting nails. U.S. Pat. No. 2,031,024, which issued to G. Ahlquist on Feb. 18, 1936, discloses a punch utilized for forming a circular aperture in a piece of sheet metal. The device utilizes a ram having a pointed tip and a cooperating recessed die. U.S. Pat. No. 2,783,799, which issued to B. Hart on Mar. 5, 1957, discloses a nail set device which utilizes a ram which is spring biased for a return stroke after being driven with a hammer. U.S. Pat. No. 2,979,092, which issued to R. Bradford on Apr. 11, 1961, discloses a nail setting device which utilizes a stepped diameter cylindrical ram which is slidably received in a longitudinal bore of a hollow cylindrical barrel. The ram is spring biased for an upward return stroke after being driven downwardly by a hammer. U.S. Pat. No. 4,390,050, which issued to L. Whitney on June 28, 1983, discloses a pair of pliers designed to grasp a short nail or tack for support while being pounded into a work piece by a hammer. The pliers include a pair of jaws between which the tack is held and extends outwardly from one end thereof, while the hammer is struck against the opposite end of the jaws. U.S. Pat. No. 4,403,725, which issued to N. Lawrence on Sept. 13, 1983, discloses a nail holding and driving device which utilizes a hollow cylindrical barrel in which a cylindrical ram is slidably received. Cooperating spring biased pivotal jaws on the end of the hollow cylindrical barrel grasp the nail while it is being driven. A thumb operated trigger is provided for opening and closing the jaws.

While the above mentioned devices are suited for their intended usage, none of these devices provide a nailing device capable of efficiently starting, driving and setting nails. Additionally, none of the aforesaid nailing devices provide a spring ball detent for retaining a nail within a hollow cylindrical barrel for driving by a stepped diameter cylindrical ram. An additional feature of the present invention, not disclosed by the previously described prior art nailing devices, is the provision of a telescopically adjustable stepped diameter cylindrical ram for adjusting the depth to which nails are driven. A further novel feature of the present invention is the provision of a nailing device with exchangeable adaptor tips enabling various sizes of nails to be utilized. Inasmuch as the art is relatively crowded with respect to these various types of nailing devices, it can be appreciated that there is a continuing need for and interest in improvements to such nailing devices, and in this respect, the present invention addresses this need and interest.

SUMMARY OF THE INVENTION

In view of the foregoing disadvantages inherent in the known types of nailing devices now present in the prior art, the present invention provides an improved nailing device. As such, the general purpose of the present invention, which will be described subsequently in greater detail, is to provide a new and improved nailing device which has all the advantages of the prior art nailing devices and none of the disadvantages.

To attain this, representative embodiments of the concepts of the present invention are illustrated in the drawings and make use of a hand held nailing device for use in starting, driving, and setting nails which is composed of a hollow cylindrical barrel having a stepped diameter longitudinal bore. An abutment shoulder is formed by the intersection of first and second diameter portions of the longitudinal bore. A stepped diameter cylindrical ram is slidably received within the barrel. An annular stop face is formed by the intersection of a first smaller diameter portion and a second larger diameter portion of the cylindrical ram. A ball receiving aperture is formed through the side wall of the barrel, adjacent a first end of the barrel. A spherical ball is retained in the aperture by a leaf spring secured to the outer wall surface of the barrel. In use, the nail head is retained within the barrel by the ball detent mechanism. By striking the end of the ram, the nail will be driven into the desired location on a work surface until the stop face on the ram contacts the abutment shoulder within the barrel. By appropriately dimensioning the barrel and the ram, the device may be adapted for use with a variety of different sized nails. Additional features contemplated by the present invention include an adjustable length ram for varying the depth to which a nail will be driven and a two piece construction of the nailing device whereby adaptor tips may be changed for use with different sizes of nails.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved nailing device which has all the advantages of the prior art nailing devices and none of the disadvantages.

It is another object of the present invention to provide a new and improved nailing device which may be easily and efficiently manufactured and marketed.

It is a further object of the present invention to provide a new and improved nailing device which is of a durable and reliable construction.

An even further object of the present invention is to provide a new and improved nailing device which is susceptible of a low cost of manufacture with regard to both materials and labor, and which accordingly is then susceptible of low prices of sale to the consuming public, thereby making such nailing devices economically available to the buying public.

Still yet another object of the present invention is to provide a new and improved nailing device which provides in the apparatuses and methods of the prior art some of the advantages thereof, while simultaneously overcoming some of the disadvantages normally associated therewith.

Still another object of the present invention is to provide a new and improved nailing device for starting, driving and setting nails in an efficient manner.

Yet another object of the present invention is to provide a new and improved nailing device which utilizes a spring ball detent mechanism to retain a nail within a hollow cylindrical barrel for driving by a stepped diameter cylindrical ram.

Even still another object of the present invention is to provide a new and improved nailing device which utilizes a telescopically adjustable cylindrical ram for varying the depth to which a nail is driven and a plurality of interchangeable adaptor tips for enabling use of a variety of different sizes of nails.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a nailing device according to a first embodiment of the present invention.

FIG. 2 is a longitudinal cross sectional view of the nailing device according to a first embodiment of the present invention.

FIG. 3 is an end view of the nailing device according to a first embodiment of the present invention.

FIG. 4 is a longitudinal cross sectional view of a telescopically adjustable ram for use in the nailing device of the present invention.

FIG. 5 is a side view of a nailing device according to a second embodiment of the present invention.

FIG. 6 is a longitudinal cross sectional view of the nailing device according to the second embodiment of the present invention.

FIG. 7 is an end view of the nailing device according to a second embodiment of the present invention.

FIG. 8 is a transverse cross sectional view taken along line 8—8 of FIG. 6, illustrating the double wall construction of the adaptor tip of the nailing device according to the second embodiment of the present invention.

DESCRIPTION OF THE PREFERRED EMBODIMENT

Figure 9:
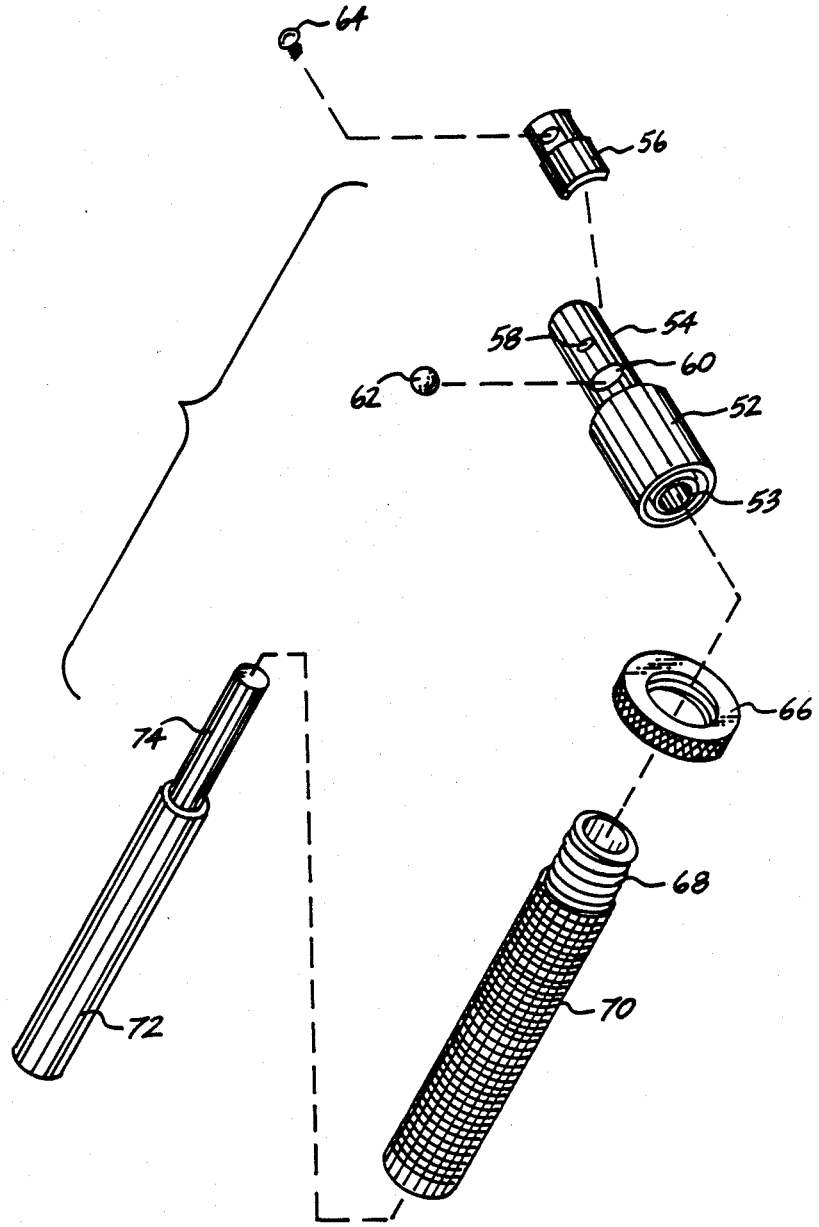
FIG. 9 is an exploded perspective view of the nailing device according to the second embodiment of the present invention.

With reference now to the drawings, and in particular to FIG. 1 thereof, a new and improved nailing device embodying the principles and concepts of the present invention and generally designated by the reference numeral 10 will be described.

More specifically, it will be noted that the first embodiment 10 of the invention includes a hollow cylindrical barrel 12 in which a ram 14 is slidably received. The outer cylindrical surface of the barrel 12 is provided with a knurling at 16 to facilitate grasping of the barrel in the hand of a user. A pair of screws 18 and 20 secure a leaf spring 22 to the side wall of the barrel 12 adjacent a first end portion thereof. A spherical ball 24 is received in an aperture in the side wall of the barrel 12. The ball 24 is retained in the aperture by the leaf spring 22. The tip of a nail N is shown projecting from the first end of the barrel 12.

In the cross sectional view of FIG. 2, it may be seen that the nail N is retained within a first diameter portion 26 of a longitudinal bore in the cylindrical barrel 12 by engagement of the ball 24 with the head of the nail N. An abutment shoulder 28 is formed by the intersection of the first diameter portion 26 with a second larger diameter portion 30. The ram 14 has a cooperating annular stop face 32 formed by the intersection of a smaller diameter portion 15 with the larger diameter portion of the ram 14. As may now be readily understood, the depth to which the nail N will be driven is determined by the dimensions and relative positions of the first end of the barrel 12, the abutment shoulder 28 and the annular stop face 32. By forming the barrel 12 and ram 14 of appropriate dimensions, a variety of different sizes of nails may be utilized. In use, a nail N is inserted into the first end of the barrel 12 until the head of the nail N is retained by the ball 24, as shown. The first end of the barrel 12 is then placed adjacent the surface of a work piece to be nailed, and the exposed end of the ram 14 is struck by a hammer. The nail N will be automatically set to an appropriate distance below the surface of the work piece, as controlled by the previously described selected dimensions. The head of the nail N will be allowed to pass the ball 24 by displacing the ball 24 against the bias of the leaf spring 22. After passage of the nail head, the ball 24 returns to its original position.

In FIG. 3, an end view of the first end of the nailing device 10 of the present invention is provided. It should be noted that in this view, the nail is not inserted into the barrel 12.

In FIG. 4, an alternative construction of a ram 14' is depicted. In this construction, the small diameter portion 15' of the ram 14' is received in a threaded longitudinal bore 19 in the ram 14'. A lock washer 17 secures the smaller diameter portion 15' at any adjusted length. By use of this alternative form of ram 14', a nail N may be driven to any desired depth, by adjusting the smaller diameter portion 15' within the threaded bore 19.

With reference now to FIG. 5, a second embodiment 50 of a nailing device according to the present invention will now be described. The second embodiment 50 has an exchangeable adaptor tip 52 with a reduced external diameter portion 54. A spherical ball 62 is received in an aperture through the cylindrical side wall of the reduced diameter portion 54. The ball 62 is retained by a leaf spring 56 secured to the side wall of the reduced diameter portion 54 by a screw 64. The adaptor tip 52 is received on a threaded portion 68 of a hollow cylindrical barrel 70. A lock washer 66 is utilized to secure the adaptor tip 52 in a desired adjusted position. The hollow cylindrical barrel 70 is provided with a knurled external surface for facilitating grasping in the hand of a user. A cylindrical ram 72 is slidably received within the hollow barrel 70 and within a longitudinal bore in the adaptor tip 52.

As shown in FIG. 6, the adaptor tip portion 52 has a double walled construction provided with an internal thread for engagement with the external thread 68 on the barrel 70. The inner wall 53 of the adaptor tip 52 forms an abutment shoulder 55 within the barrel 70. A cooperating annular stop face 71 is formed on the ram 72 at the intersection of a smaller diameter portion 74 with the larger diameter body portion of the ram 72. The adjustable ram of the type illustrated in FIG. 4 may also be utilized in the nailing device according to the second embodiment of the present invention. This embodiment of the nailing device is utilized in an analogous fashion as that described with reference to the first embodiment. By use of appropriately dimensioned replaceable adaptor tips 52, a variety of different sizes of nails may be employed. The internal diameter and length of each adaptor tip 52 will be varied depending upon the size of nail to be utilized.

FIG. 7 provides an end view of the nailing device according to the second embodiment of the invention, with the nail N removed.

FIG. 8 provides a transverse cross sectional view of the adaptor tip 52, illustrating the double walled construction.

The construction and assembly of the various components of the nailing device 50 may be better understood with reference to the exploded perspective view of FIG. 9.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A nailing device, comprising:
- a hollow cylindrical barrel;
- a longitudinal bore in said cylindrical barrel;
- an external thread at a first end of said barrel;
- a lock washer threaded on said first end of said cylindrical barrel;
- a replaceable adaptor tip threaded on said first end of said cylindrical barrel, said adaptor tip mounted for axial adjustment with respect to said cylindrical barrel, depending on the intended length and driving depth of a nail to be driven;
- said adaptor tip having a double walled portion forming an annular recess with an internal thread for engagement with said first end of said cylindrical barrel;
- an inner wall of said double walled portion received in said longitudinal bore of said cylindrical barrel and forming an abutment shoulder;
- a ball receiving aperture formed through a side wall of said adaptor tip;
- a spherical ball in said aperture;
- a spring retainer secured to the side wall of said adaptor tip for retaining said ball in said aperture;
- a stepped diameter cylindrical ram having a larger diameter portion and a smaller diameter portion;
- said ram slidably received in said barrel; and
- an annular stop face formed at an intersection of said larger and smaller diameter ram portions for cooperation with said internal abutment shoulder.

2. The nailing device of claim 1, wherein knurling is provided on the exterior side wall of said hollow cylindrical barrel.

3. The nailing device of claim 1, wherein said smaller diameter portion of said ram is threadably received within said larger diameter portion of said ram to allow adjustment of the axial length of said ram dependent on the intended length and driving depth of a nail to be driven.

* * * * *